US005172623A

United States Patent [19]

Poisson

[11] Patent Number: 5,172,623

[45] Date of Patent: Dec. 22, 1992

[54] HYDRAULIC ROTARY MACHINE WITH PRE-DISCHARGE OPENING FOR LUBRICATION SUPPLY

[75] Inventor: Pierre Poisson, Viroflay, France

[73] Assignee: Messier-Bugatti, Velizy-Villacoublay, France

[21] Appl. No.: 724,702

[22] Filed: Jul. 2, 1991

[30] Foreign Application Priority Data

Jul. 10, 1990 [FR] France ..... 90 08741

[51] Int. Cl.[5] ..... F04B 39/02; F03C 1/253

[52] U.S. Cl. ..... 91/46; 91/487; 92/156; 184/6.17; 417/269

[58] Field of Search ..... 92/71, 72, 70, 153, 92/154, 156; 91/46, 486, 487; 184/6.17; 417/269

[56] References Cited

U.S. PATENT DOCUMENTS 2,331,694 10/1943 Jeffrey ..... 91/486
3,249,061 5/1966 Ricketts ..... 91/486
3,800,673 4/1974 Lutz et al. .
3,999,466 12/1976 Aschke .
5,044,892 9/1991 Pettitt ..... 184/6.17 X

FOREIGN PATENT DOCUMENTS 812202 4/1959 United Kingdom ..... 184/6.17

*Primary Examiner*—Edward K. Look
*Assistant Examiner*—John Ryznic
*Attorney, Agent, or Firm*—Sixbey, Friedman, Leedom & Ferguson

[57] ABSTRACT

The rotary machine of the invention includes a series of cylindrical chambers swept by pistons in hydraulic liquid admission-and-discharge cycles and alternately connected to high pressure openings and to low pressure openings during each revolution of the machine, wherein said machine it includes a pre-discharge opening disposed between the high pressure opening and the low pressure opening in that order relative to a direction of rotation of the machine, and wherein the pre-discharge opening is connected by a connecting duct to rotary support devices to cause hydraulic fluid to pass through the rotary support devices.

2 Claims, 1 Drawing Sheet

HYDRAULIC ROTARY MACHINE WITH PRE-DISCHARGE OPENING FOR LUBRICATION SUPPLY

The present invention relates to a hydraulic rotary machine such as a hydraulic motor or pump.

BACKGROUND OF THE INVENTION

There exist hydraulic rotary machines which include a series of cylindrical chambers swept by pistons in hydraulic liquid admission-and-discharge cycles, and alternately connected to high pressure openings and to low pressure openings during each revolution of the machine. These rotary machines are equipped with rotary support devices disposed in a casing which is itself filled with hydraulic liquid to ensure that the rotary support devices are lubricated. When a rotary machine rotates fast, the temperature of the rotary support devices rises and this affects lubrication.

An object of the present invention is to propose a rotary machine with improved lubrication of the rotary support devices.

SUMMARY OF THE INVENTION

In order to achieve this object, the invention provides a hydraulic rotary machine including a pre-discharge opening disposed between the high pressure opening and the low pressure opening in that order relative to a direction of rotation of the machine, and in which the pre-discharge opening is connected by a connecting duct to at least one rotary support device to cause hydraulic fluid to pass through the rotary support device.

In this way forced lubrication is established through the rotary support devices which are swept by the hydraulic fluid, and as a result the lubrication is improved without taking off power and thus without reducing the performance of the hydraulic machine. This improvement in lubrication means that the rotary support devices last longer.

In an advantageous embodiment of the invention, in which the rotary machine includes a plurality of rotary support devices, the machine includes connection ducts defining parallel paths for the hydraulic fluid. In this way, hydraulic fluid passes through each rotary support device at a relatively low temperature which favors optimum lubrication.

BRIEF DESCRIPTION OF THE DRAWINGS

An embodiment of the invention is described by way of example with reference to the accompanying drawing, in which.

DETAILED DESCRIPTION

Figure 1:
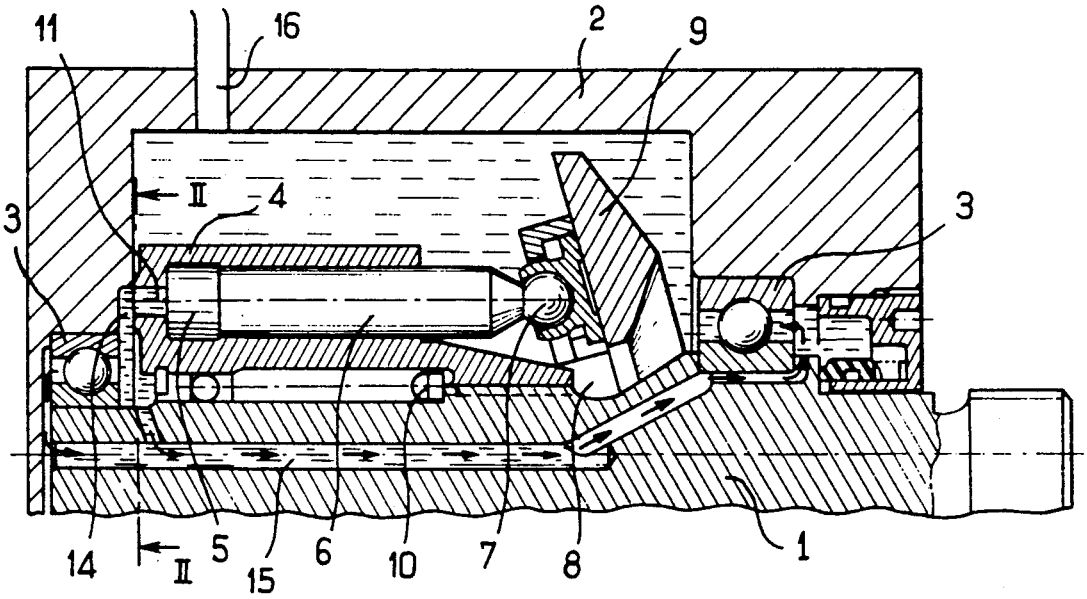
FIG. 1 is an axial section through part of a rotary machine of the invention, on line I—I in FIG. 2.

The rotary machine of the invention shown in the figures conventionally comprises a rotary shaft 1, supported in a casing 2 by rotary support devices such as ball bearings 3. The shaft 1 carries a cylinder block 4 which includes a series of cylindrical chambers 5 swept by axial pistons 6. Each piston 6 includes a ball 7 at one end, with an actuator skid 8 receiving the balls and bearing against a swash-plate 9. The end of the cylinder block 4 distant from the swash-plate 9 is pressed against a face of the casing 2 by a spring 10 and by appropriate hydraulic forces. During rotation of the shaft 1, the admission-and-discharge opening 11 of each cylindrical chamber 5 comes alternately over a high pressure opening 12 and over a low pressure opening 13, which openings are suitably connected to admission ducts and to discharge ducts.

Figure 2:
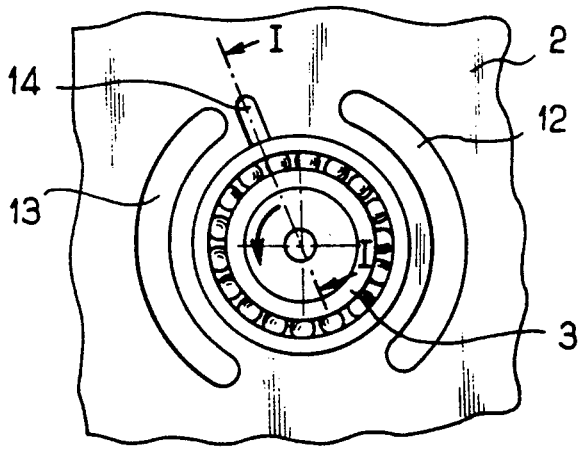
FIG. 2 is a fragmentary section on line II—II in FIG. 1.

According to the invention, the rotary machine includes a pre-discharge opening 14 disposed between the high pressure opening 12 and the low pressure opening 13 in that order relative to a direction of rotation of the machine as indicated by an arrow on FIG. 2. The pre-discharge opening 14 is connected to the bearings 3 by a connection duct 15, extending generally axially inside the shaft 1 and including lengths defining two parallel paths passing through the bearings 3 and opening into the inside of the casing 2. In order to avoid excess pressure inside the casing 2, said casing is connected by a return duct 16 to a reservoir of hydraulic fluid, not shown.

Each time one of the admission-and-discharge openings 11 passes over the pre-discharge opening 14, a pulse of hydraulic fluid under pressure is sent along the connecting duct 15 and through the bearings 3, thereby providing forced lubrication of these bearings.

Of course the invention is not limited to the embodiment illustrated and variants can be applied to it without departing from the scope of the invention. In particular, although the invention has been described in conjuction with a hydraulic machine comprising axial pistons, it can also be applied to a hydraulic machine comprising radial pistons, whether this machine is used as a pump or as a motor, the pre-discharge opening being disposed in the top dead center are for a pump and in the bottom dead center area for a motor.

I claim:

1. A hydraulic rotary machine including a casing and a series or rotatable cylindrical chambers swept by pistons in hydraulic liquid admission-and-discharge cycles and having admission-and-discharge openings alternately facing high pressure and low pressure openings of the casing during each revolution of the machine, wherein said machine includes a pre-discharge opening disposed between the high pressure opening and the low pressure opening in that order relative to a direction of rotation of the machine, the pre-discharge opening being connected by a connecting duct to at least one rotary support device and being intermittently faced by the admission-and-discharge openings of the cylindrical chambers upon rotation of the machine in order to cause hydraulic fluid to be positively supplied through the rotary support device.

2. A hydraulic rotary machine according to claim 1, including a plurality of rotary support devices and wherein it includes connection ducts for defining parallel paths for the hydraulic fluid.

* * * * *